US007257355B2

(12) United States Patent
Tomoe et al.

(10) Patent No.: US 7,257,355 B2
(45) Date of Patent: Aug. 14, 2007

(54) TONER SUPPLY DEVICE

(75) Inventors: Tetsuro Tomoe, Osaka (JP); Tetsuo Tanda, Osaka (JP); Kenichi Tanabe, Hirakata (JP)

(73) Assignee: Kyocera Mita Corporation, Osaka (JP)

( * ) Notice: Subject to any disclaimer, the term of this patent is extended or adjusted under 35 U.S.C. 154(b) by 9 days.

(21) Appl. No.: 11/163,775

(22) Filed: Oct. 31, 2005

(65) Prior Publication Data

US 2006/0093405 A1 May 4, 2006

(30) Foreign Application Priority Data

Oct. 29, 2004 (JP) ..... 2004-315773
Jan. 31, 2005 (JP) ..... 2005-023821
Jun. 27, 2005 (JP) ..... 2005-186911

(51) Int. Cl.
*G03G 15/00* (2006.01)
*G03G 15/01* (2006.01)
*G03G 15/08* (2006.01)

(52) U.S. Cl. ..... 399/258; 399/260; 399/262; 399/119; 399/120; 222/160; 222/240; 222/241; 222/DIG. 1

(58) Field of Classification Search ..... 399/119, 399/120, 258, 260, 262; 222/160, 240, 241, 222/DIG. 1
See application file for complete search history.

(56) References Cited

U.S. PATENT DOCUMENTS 5,187,524 A * 2/1993 Cherian ..... 399/258
2006/0093391 A1* 5/2006 Uchida et al. ..... 399/92
2006/0093401 A1* 5/2006 Tanda ..... 399/227
2006/0093402 A1* 5/2006 Tomoe ..... 399/227
2006/0093403 A1* 5/2006 Tanda ..... 399/227
2006/0193659 A1* 8/2006 Tanda ..... 399/258
2006/0219114 A1* 10/2006 Iketani ..... 101/232
2006/0222413 A1* 10/2006 Nagae ..... 399/262

FOREIGN PATENT DOCUMENTS

JP 10198149 A * 7/1998
JP H10/198149 A 7/1998
JP 2001/134045 A 5/2001
JP 2004/45960 A 2/2004

* cited by examiner

*Primary Examiner*—David M. Gray
*Assistant Examiner*—Ruth N. LaBombard
(74) *Attorney, Agent, or Firm*—Global IP Counselors, LLP

(57) ABSTRACT

A toner supply device is disclosed that supplies toner contained in a toner container to a developing device in an image forming device. The toner supply device includes a conveyance pipe for conveying the toner from the toner container to the developing device downward, and at least one supply pipe for supplying the toner from the conveyance pipe to the developing device downward. The conveyance pipe is connected to the toner container for conveying the toner from the toner container to the developing device. The supply pipe has an upper portion connected to the conveyance pipe and a lower end capable of advancing into the developing device. In addition, a conveyance member is rotatably located in the supply pipe for conveying the toner downward. The supply pipe is located such that a center axis of the supply pipe is slanted relative to the horizontal line at a repose angle of the toner or more.

13 Claims, 6 Drawing Sheets

TONER SUPPLY DEVICE

BACKGROUND OF THE INVENTION

1. Field of the Invention

The present invention relates to a toner supply device, and more particularly to a toner supply device for supplying toner from a toner container located apart from a developing device to the developing device.

2. Background Information

An image forming device utilizing an electrophotographic system includes a photosensitive drum as an image bearing member and other devices located circumferentially around the drum, such as a charger, an exposure device, a developing device, a transfer device, a cleaning device, and so on. In addition, a fixing device is provided downstream of the photosensitive drum in a direction in which the transfer device extends. In this image forming device, first, a surface of the photosensitive drum is uniformly charged by the charger. Then, the photosensitive drum is exposed by the exposure device in accordance with image data so that an electrostatic latent image is formed on the photosensitive drum. The electrostatic latent image is developed by the developing device. In a case of the full color image forming device, four developing units are provided for storing cyan developer, magenta developer, yellow developer, and black developer. The developing units develop the latent image to a toner image with four colors (cyan, magenta, yellow, and black). After that, the toner image is transferred to a transfer medium by the transfer device and then fixed to the transfer medium by the fixing device, and the transfer medium is finally discharged to a discharge unit. Residual developer remaining on the photosensitive drum is cleaned by the cleaning device.

In the above-mentioned image forming operation, the toner in the toner container is consumed as the development is carried out so that it is necessary to refill the toner. There are two systems to compensate for the toner consumed by the image forming operation.

The first system is to fill a certain amount of the toner in the developing unit and replace the developing units when the toner is completely consumed, as shown in Japanese Unexamined Patent Publication No. 2004-45960. In this system, the developing unit and the toner container are formed into a cartridge, so that it is not necessary to supply the toner to the developing unit. Consequently, it is easy to maintain the developing unit.

The second system is to provide a toner container outside of the developing unit so as to supply the toner to the developing unit from outside, as shown in Japanese Unexamined Patent Publications No. 2001-134045 and No. 10-198149. Recently, as full color image forming devices have been increasingly used by individuals, there have been demands to reduce the size of the image forming device. It is necessary to reduce the size of the developing units in order to reduce the size of the image forming device. In the second system, by providing the toner container outside of the developing unit, the developing unit will be reduced in size.

In the first system wherein the developing unit and the toner container are formed into a cartridge, it is necessary to fill the toner for about 4,000 sheet printing in the developing unit in advance because the toner is not supplied to the developing unit from outside. As a result, it is difficult to reduce the developing unit in size. Although it is possible to set a printing capability of toner to 4,000 sheets or under, the cost per one sheet increases in that case. In addition, when the toner is completely consumed, it is necessary to replace the developing units each time. As a result, it increases the burden on the environment.

On the contrary, in the system wherein the toner container is provided outside of the developing unit and the toner is supplied to the developing unit from outside, it is necessary to prepare a member for supplying the toner from the toner container to the developing unit. For example, a plurality of toner supply paths are provided for supplying the toner to each of the developing units in the device shown in Japanese Unexamined Patent Publication No. 2001-134045, and a plurality of toner supply pipes are provided for supplying the toner to each of the developing units in the device shown in Japanese Unexamined Patent Publication No. 10-198149. The toner is supplied to the developing units through the toner supply paths or the toner supply pipes from the toner container.

However, in the conventional devices, the toner may remain in the toner supply paths or the toner supply pipes. In particular, in the device shown in Japanese Unexamined Patent Publication No. 10-198149, the toner supply pipes advance and retreat relative to the developing units, so that when the toner supply pipe leaves the developing unit, the toner remaining in the toner supply pipes scatter about so as to contaminate inside of the device.

Furthermore, in the conventional device, it is difficult to precisely manage the amount of the toner supply when the toner is supplied from the toner container to the developing unit, because the toner in the toner container is supplied to the developing device by free fall.

It is an object of the present invention to restrain the toner from remaining in the toner supply unit and from contaminating the inside of the device when the toner is supplied to the developing unit from the toner container located apart from the developing unit.

It is another object of the present invention to precisely manage the amount of the toner supply to the developing unit with a simple structure.

SUMMARY OF THE INVENTION

A toner supply device according to a first aspect of the present invention supplies toner contained in a toner container to a developing device in an image forming device. The toner supply device comprises a conveyance pipe for conveying the toner from the toner container to the developing device downward, and at least one supply pipe for supplying the toner from the conveyance pipe to the developing device downward. The conveyance pipe is connected to the toner container for conveying the toner from the toner container to the developing device. The supply pipe has an upper portion connected to the conveyance pipe and a lower end capable of advancing into the developing device. In addition, a conveyance member is rotatably located in the supply pipe for conveying the toner downward. The supply pipe is located such that a center axis of the supply pipe is slanted relative to the horizontal line at a repose angle of the toner or more.

In the device, the toner container is located apart from the developing device, and the toner is conveyed to the supply pipe through the conveyance pipe, and then to the developing device downward.

Although the toner is supplied downward to the developing device within the supply pipe, the remainder of the toner within the toner pipe is restrained because the supply pipe is located such that the center axis of the supply pipe is slanted relative to the horizontal line at a repose angle of the toner or more. Consequently, the remaining toner is prevented from contaminating inside of the device when the supply pipes are pulled out from the developing device.

According to a second aspect of the present invention, the toner supply device according to the first aspect further comprises an image bearing member having a surface on which an electrostatic image is formed. The developing device includes a plurality of developing units and a rotary frame. The developing units are located corresponding to different developing colors. The rotary frame maintains the developing units in a circumferential direction in order to place each of the developing units opposite the image bearing member by means of rotation. The supply pipes are located corresponding to the developing units.

As mentioned above, the image forming device comprises a rotary developing device having developing units arranged in the circumferential direction which are placed opposite to the image bearing member by means of rotation. The size of the image forming device as a whole is reduced because the diameter of the rotary frame can be reduced by locating the toner container outside of the developing device.

According to a third aspect of the present invention, in the toner supply device according to the first or second aspects, the supply pipe has a shutter mechanism for prohibiting and allowing toner to be supplied to the developing device.

In the device, the shutter mechanism located at the supply pipe is opened when supplying the toner from the supply pipe to the developing device, while the shutter mechanism is closed when stopping the supply of the toner to the developing device. Accordingly, even if the toner remains in the supply pipe, the toner does not leak from the supply pipe.

According to a fourth aspect of the present invention, in the toner supply device according to the third aspect, the supply pipe includes an inner cylinder having an inner opening in the tip thereof, and an outer cylinder rotatably located around the inner cylinder and having an outer opening in a lateral surface of the tip thereof. The shutter mechanism is formed by means of the inner cylinder and the outer cylinder.

According to a fifth aspect of the present invention, the toner supply device according to the fourth aspect further comprises a driving device and a shutter driving mechanism. The driving device moves the tip of the supply pipe into the developing device and away from the developing device. The shutter driving mechanism aligns at least part of the inner opening of the inner cylinder and the outer opening of the outer cylinder with each other when the tip of the supply pipe advances into the developing device, and misaligns the inner opening with the outer opening when the tip is located outside of the developing device.

In the developing unit, when the toner is supplied, the tip of the supply pipe is moved into the developing device by the driving device and at least part of the inner opening of the inner cylinder and the outer opening of the outer cylinder are aligned. As a result, the toner in the supply pipe is supplied to the developing device. When the supply of the toner is finished, the tip of the supply pipe is retracted from the inside of the developing device. When tip of the supply pipe is moved out of the developing device, the inner opening and the outer opening are misaligned by the shutter driving mechanism so that the toner inside of the supply pipe will not escape, i.e., toner leakage from the supply pipe is prevented.

According to a sixth aspect of the present invention, in the toner supply device according to the fifth aspect, the outer opening of the outer cylinder is larger than the inner opening of the inner cylinder.

In the device, when the outer cylinder rotates relative to the inner cylinder, even if there are some errors in the rotational angle, it is possible to supply the toner to the developing device. Furthermore, for example, by closing a gap between the inner cylinder and outer cylinder, the toner will not go into the gap between the inner cylinder and the outer cylinder so that the toner will neither scatter nor contaminate the inside of the device during toner replacement.

According to a seventh aspect of the present invention, in the toner supply device according to the fifth aspect, the shutter driving mechanism rotates the outer cylinder as the supply pipe is moved by means of the driving force of the driving device.

According to an eighth aspect of the present invention, in the toner supply device according to the seventh aspect, the shutter driving mechanism includes a guide portion located on an outer circumference of the outer cylinder and a spiral guide groove around the outer cylinder into which the guide portion is inserted.

In the device, the guide portion provided on the surface of the outer cylinder moves along the spiral guide groove located around the outer cylinder so that the outer cylinder rotates in accordance with the movement of the guide portion.

According to a ninth aspect of the present invention, in the toner supply device according to the second aspect, the developing unit is formed with a toner supply opening, and a shutter is provided at the toner supply opening of the developing unit.

In the device, the shutter is provided at the toner supply opening of the developing unit, so that the shutter is opened to supply the toner to the developing device through the supply pipe, and the shutter is closed to stop supplying the toner. Consequently, the toner will not leak from the toner supply opening to the inside of the device.

According to a tenth aspect of the present invention, an image forming device comprises an image forming unit, a sheet conveyance unit, and a toner supply unit. The image forming unit forms a toner image and transfers the toner image onto a sheet (transfer medium). The sheet conveyance unit conveys the sheet to the image forming unit. The toner supply unit supplies the toner to the image forming unit and includes a toner supply member for supplying the toner to the image forming unit, a toner container for storing the toner, and a toner conveyance unit having a toner conveyance member inside for conveying the toner in the toner container to the toner supply member. The toner conveyance unit has a portion upstream in a toner conveyance direction that is lower than a downstream portion thereof in the toner conveyance direction.

In the image forming device, in the event of toner supply, the toner in the toner container is conveyed to the toner supply member through the toner conveyance unit. The toner inside the toner container is conveyed to the toner supply member through the portion upstream in the toner conveyance direction that is lower than the portion downstream in the toner conveyance direction. In this case, the toner is unlikely to free fall, and is conveyed by means of conveyance force by the toner conveyance member because the downstream side is higher than the upstream side in the toner conveyance direction.

The amount of the toner supply to the toner supply member by the toner conveyance member is precisely managed compared to conventional ones because the free fall of the toner is restrained.

According to an eleventh aspect of the present invention, in the toner supply device according to the tenth aspect, a connected portion between the toner conveyance unit and the toner container is located lower than a connected portion between the toner conveyance unit and the toner supply member.

According to a twelfth aspect of the present invention, in the toner supply device according to the tenth aspect, the amount of the toner conveyed by the toner conveyance unit is less than the amount of toner supplied by the toner supply member.

The toner supply member is less likely to become plugged up with the toner conveyed by the toner conveyance unit, because the amount of the toner supply by the toner supply member to the image forming unit is more than the amount of the toner conveyed by the toner conveyance unit to the toner supply member. Consequently, the amount of the toner supply is precisely managed.

According to a thirteenth aspect of the present invention, in the toner supply device according to the twelfth aspect, the amount of toner supplied from the toner container to the toner conveyance unit is less than the amount of toner conveyed by the toner conveyance unit.

The toner conveyance unit is less likely to become plugged up with the toner supplied from the toner container because the amount of the toner conveyed to the toner supply member by the toner conveyance unit is more than the amount of toner supplied from the toner container to the toner conveyance unit. Consequently, the amount of the toner supply is precisely managed.

According to a fourteenth aspect of the present invention, in the toner supply device according to the tenth aspect, a connected portion between the toner supply member and the toner conveyance unit is positioned in a position higher than a portion upstream side near the connected portion between the toner container and the toner conveyance unit.

In the device, the present invention is realized by a simple structure.

As mentioned above, in the present invention, it is possible to restrain the toner from remaining inside the toner pipe in the developing device when the toner is conveyed from the outside to the upper portion of the supply pipe, and then supplied downward to the developing device through the supply pipe, because the supply pipe is located such that the center axis of the supply pipe is slanted relative to the horizontal line at a repose angle of the toner or more. Consequently, the problem of contamination inside the device by the residual toner in the supply pipe is solved.

In addition, the present invention, the amount of the toner supply from the toner container to the image forming unit is precisely managed.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
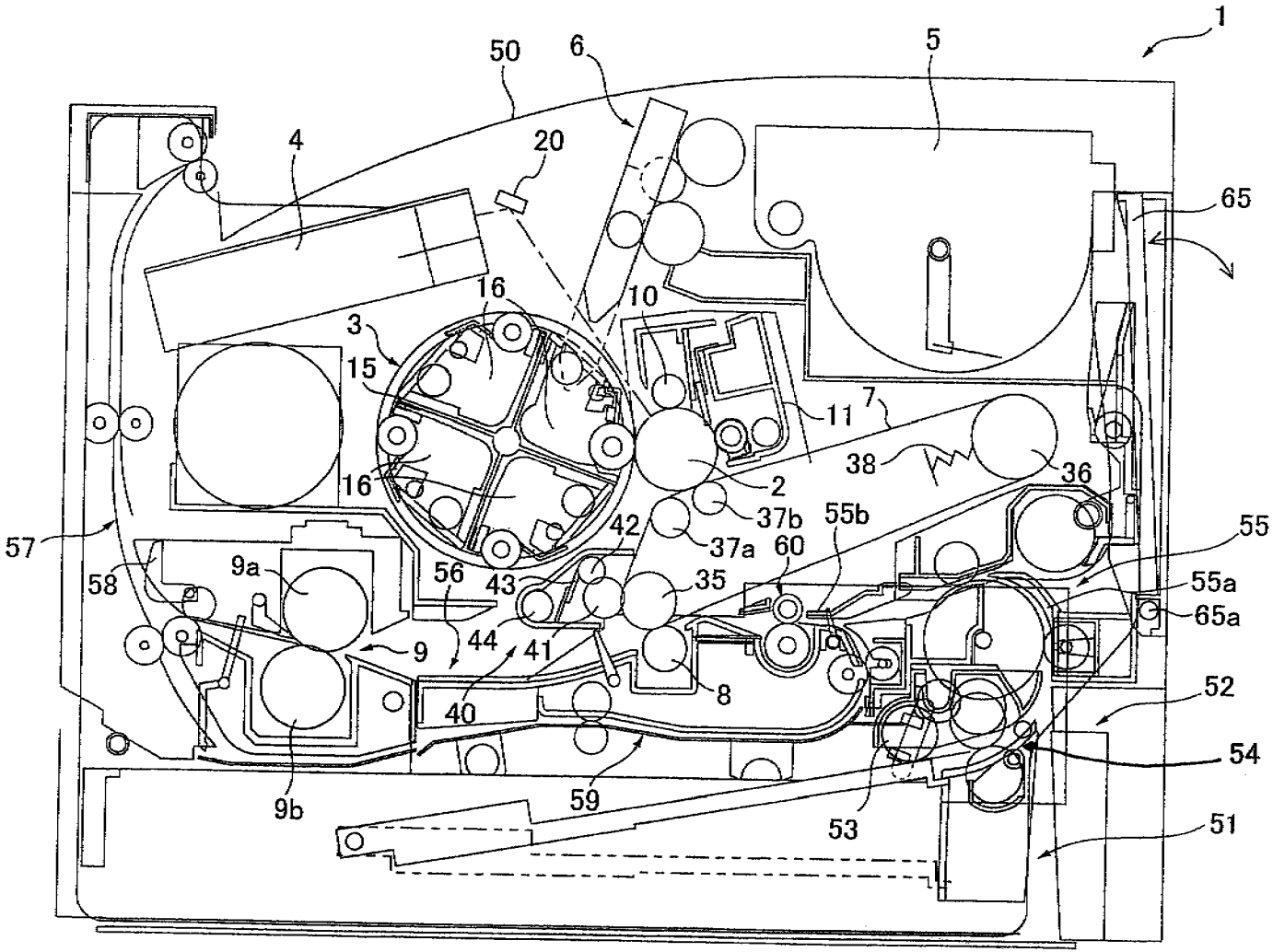
FIG. 1 is a schematic structural view of a color printer according to an embodiment of the present invention.

FIG. 1 shows a color printer 1 as a color image forming device according to one embodiment of the present invention. FIG. 1 is a view showing a frame format of locations of each of the components, and thus the details of each of portions are omitted.

Overall Structure

The color printer 1 is connected to a computer, for example, and is capable of printing a color image on a sheet in accordance with image data sent from the computer. In this color printer 1, the right side of FIG. 1 is the side from which an operator operates the color printer 1. In the below description, the right side in FIG. 1 is referred to as the "front side" and the left side in FIG. 1 is referred to as the "rear side".

The color printer 1 includes a photosensitive drum 2, a rotary developing device 3, a laser unit 4, a toner container 5, a toner supply device 6, an intermediate transfer belt 7, a secondary transfer roller 8, and a fixing device 9. In this device, the photosensitive drum 2, the rotary developing device 3, the laser unit 4, the intermediate transfer belt 7, and the secondary transfer roller 8 constitute an image forming unit.

Photosensitive Drum

The photosensitive drum 2 has a surface on which an electrostatic latent image is formed, and is rotatably mounted substantially in the center of the device. The rotational axis of the photosensitive drum 2 is located such that the axis extends in a lateral direction seen from the front side of the device, i.e., perpendicular to the plane of FIG. 1. On an upper portion of the photosensitive drum 2, a charge roller 10 for uniformly charging a surface of the photosensitive drum 2 is mounted. On a lateral side of the photosensitive drum 2, a drum cleaning device 11 is mounted for cleaning residual toner and other matter on the surface of the photosensitive drum 2.

Rotary Developing Device

The rotary developing device 3 is a device for developing an electrostatic latent image formed on the photosensitive drum 2 with each color toner. The rotary developing device 3 is located adjacent to the photosensitive drum 2 and has a center substantially corresponding to the center of the photosensitive drum 2 in a vertical direction. The rotary developing device 3 includes a rotary frame 15 and four developing units 16 corresponding to four color toners and supported by the rotary frame 15. The rotary frame 15 is a cylindrical member rotatable around an axis in parallel with the rotational axis of the photosensitive drum 2 and is driven by a driving mechanism including a motor and gears (not illustrated). In addition, the rotary frame 15 is formed with four compartments divided into quarters by partitions extending from the center of the rotational axis radially outward. Each of the compartments accommodates each of the developing units 16 corresponding to four colors toners such as yellow, cyan, magenta, and black.

Figure 2:
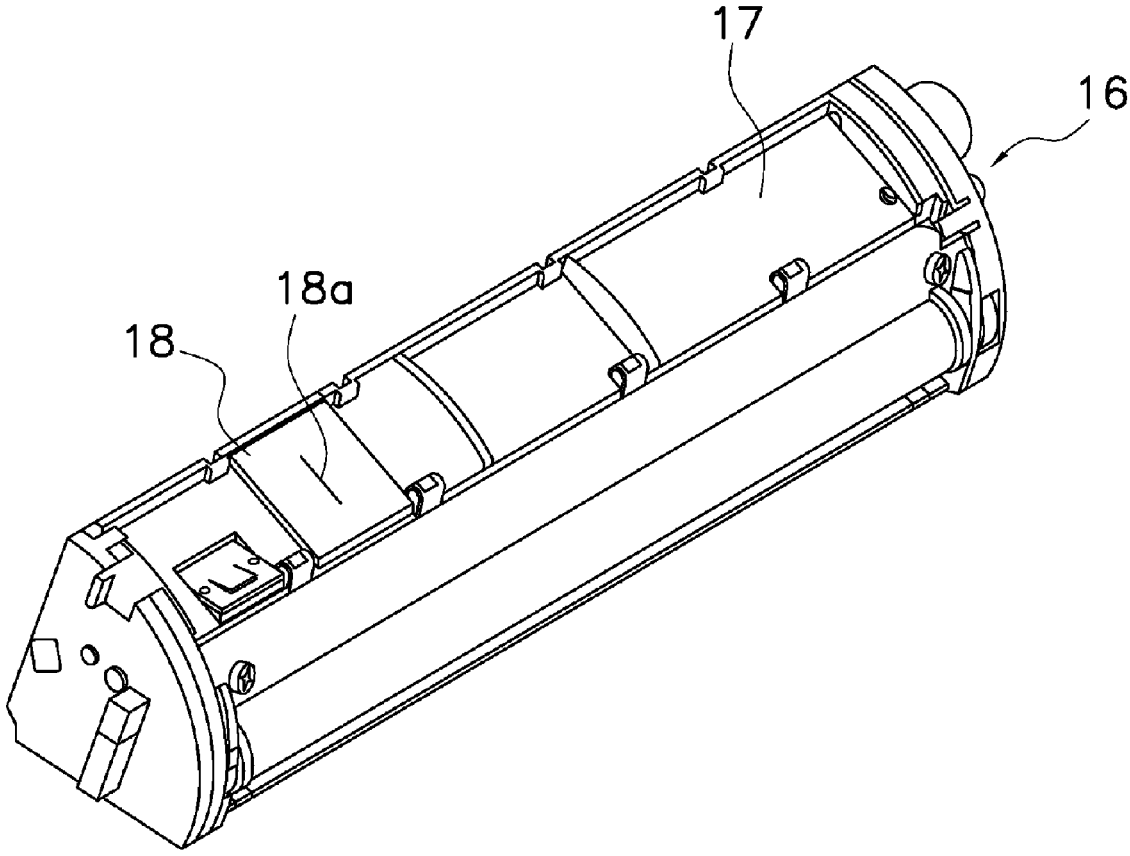
FIG. 2 is an external perspective view of the developing unit.

Each of the developing units 16 has a common structure and includes a developing roller capable of being located so as to be opposed to the photosensitive drum 2, and an agitation roller for agitating the toner. One of the four developing units 16 is shown in FIG. 2. In the present invention, a toner container (later described) is separately located apart from the developing units 16 so that toner containment space of the developing units themselves in the present embodiment is smaller. In other words, the developing units 16 are downsized compared to a developing unit including a toner container inside. On an outer surface of a case 17 of the developing unit 16, a toner supply portion 18 is provided as shown in FIG. 2 so as to supply the toner from the toner container 5 into the developing unit 16. The toner supply portion 18 having an elastic member with a slit 18*a* is located at an opening of the case 17.

Laser Unit

The laser unit 4 is a device to scan and expose the photosensitive drum 2 in accordance with image data sent from the external computer, and is located above the photosensitive drum 2 and on the rear side of the rotational axis of the rotary developing device 3. More accurately, the front end of the laser unit 4, the end from which a laser light is emitted, is located immediately above the rotational axis of the rotary developing device 3, and the rear end is located below an upper end of the rotary developing device 3, with the whole of the laser unit 4 slanting downward toward the rear end. The inner construction of the laser unit 4 is common with that of conventional laser units, and includes a laser light source, a polygon mirror, a motor for driving the polygon mirror, and so on. In addition, on the front side of a laser light path from the laser unit 4, a reflective mirror 20 is provided so that the laser light emitted from the laser unit 4 is reflected by the reflective mirror 20, then passes on the front side of and above the rotary developing device 3, and is finally applied to the surface of the photosensitive drum 2 as shown in dotted lines in FIG. 1.

Toner Container

Figure 5:
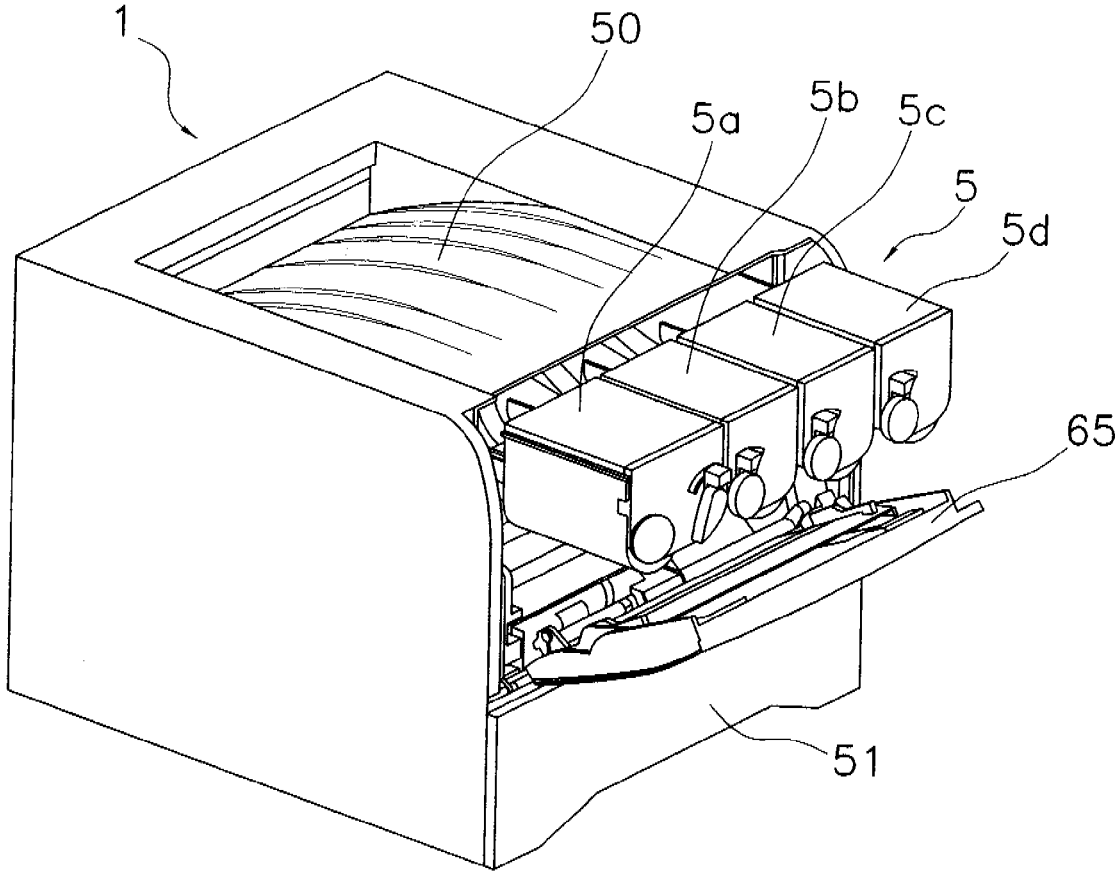
FIG. 5 is a perspective view of the device showing the toner containers extracted halfway.
Figure 6A:
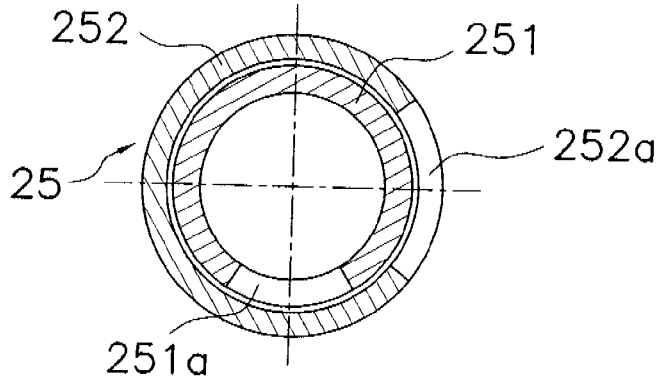
FIGS. 6(*a*), 6(*b*), and 6(*c*) are structural views of the tip of the toner supply pipe.
Figure 6B:
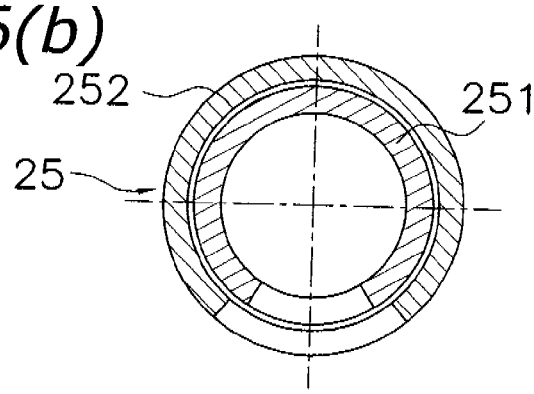
Figure 6C:
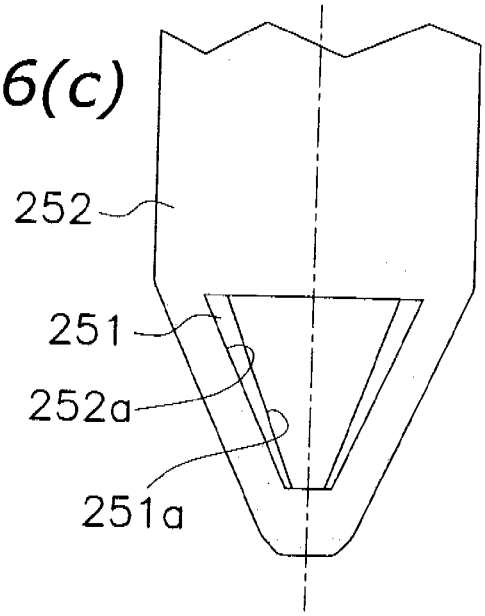

The toner container 5 is a member for storing toner to be supplied to each of the developing units 16 of the rotary developing device 3, and is located above the photosensitive drum 2 and on a side opposite to the laser unit 4 (on a front side in the device). The toner container 5 includes, as shown in FIG. 5, four containers 5*a*, 5*b*, 5*c*, and 5*d* arranged in a lateral direction, i.e., in a direction perpendicular to the plane of FIG. 1, for storing color toners such as yellow, cyan, magenta, and black. The toner container 5 can be pulled out toward the front side of the device.

Toner Supply Device

Figure 3:
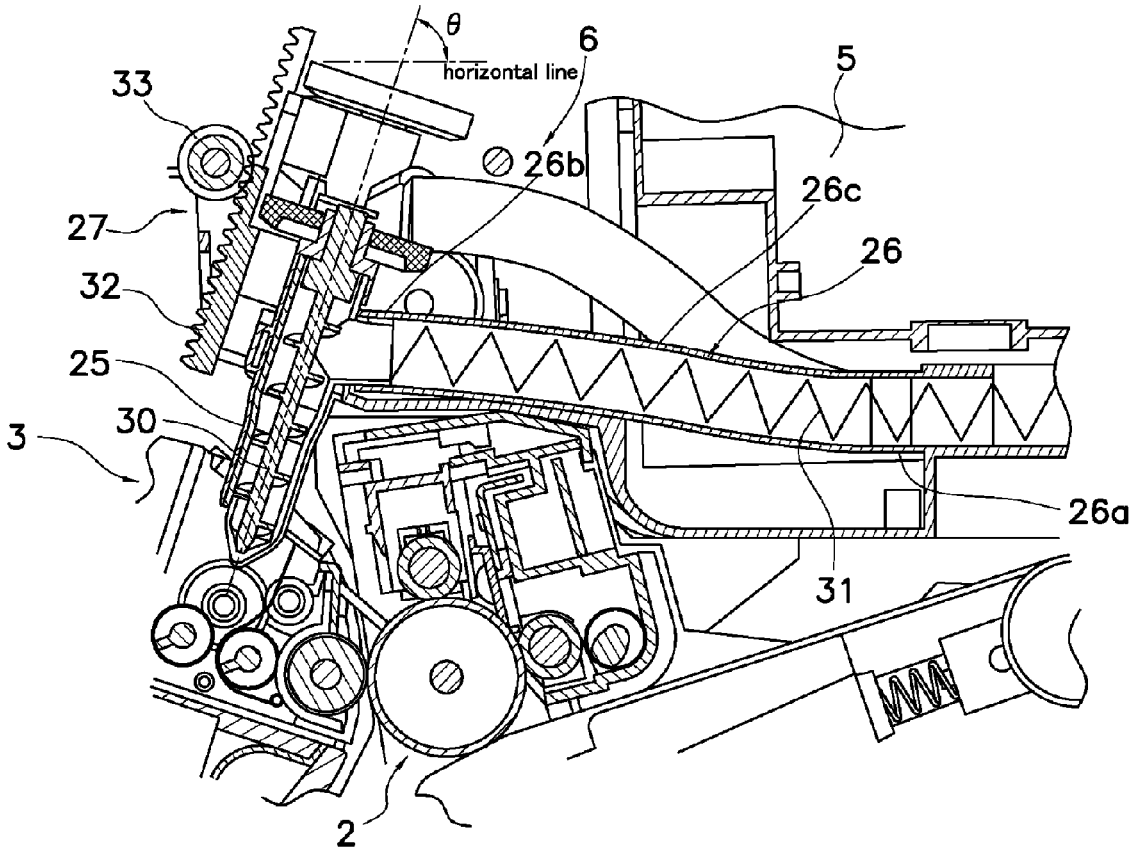
FIG. 3 is a detailed sectional structural view of the toner supply device.

The toner supply device 6 is a device to supply each of toners contained in the toner container 5 to corresponding developing units 16, and is located above the photosensitive drum 2 and in a space between the laser unit 4 and the toner container 5. The toner supply device 6 includes, as shown in FIG. 3, four toner supply pipes 25 that are vertically movable, four conveyance pipes 26 for connecting portions storing each color toner in the toner container 5 with corresponding toner supply pipes 25, and a drive mechanism 27 for moving the toner supply pipes 25 up and down.

Each toner supply pipe 25 extends vertically and is inclined such that an upper end is on the front side in the device and a lower end is on the rear side in the device. The center axis of the toner supply pipe 25 is designed to have a repose angle of toner (θ) or more relative to the horizontal line. In this embodiment, a repose angle of the black toner is 50 degrees and a repose angle of the color toner is 40 degrees so that the center axis of the toner supply pipe 25 is set to makes an angle of 70 degrees (θ) relative to the horizontal line. The toner supply pipe 25 has a tapered tip, which can advance into the inside of the developing unit 16 through the slit 18*a* of the toner supply portion 18 when the toner supply pipe 25 moves downward. Inside of the toner supply pipe 25, a spiral member 30 for conveying the toner is rotatably installed.

The conveyance pipe 26 is a member for conveying the toner supplied from the toner container 5 to the toner supply pipe 25 and is so flexible that the pipe 26 can follow vertical movements of the toner supply pipe 25. As shown in FIG. 3, the conveyance pipe 26 has a first connection portion 26*a* for connecting the conveyance pipe 26 and the toner container 5, a second connection portion 26*b* for connecting the conveyance pipe 26 and the toner supply pipe 25, and a toner conveyance portion 26*c* located between the first connection portion 26*a* and the second connection portion 26*b* for conveying the toner. As shown in FIG. 3, the second connection portion 26*b* is positioned higher than the first connection portion 26*a* even when the toner supply pipe 25 is positioned in the lowest position. The toner conveyance portion 26*c* is a part for conveying the toner from the first connection portion 26*a* to the second connection portion 26*b* and is inclined upward from the first connection portion 26*a* to the second connection portion 26*b*. Inside of the conveyance pipe 26, a coil spring 31 is provided for conveying the toner to the toner supply pipe 25 within the conveyance pipe 26 when the coil spring 31 is rotated by a drive mechanism (not illustrated).

Figure 4:
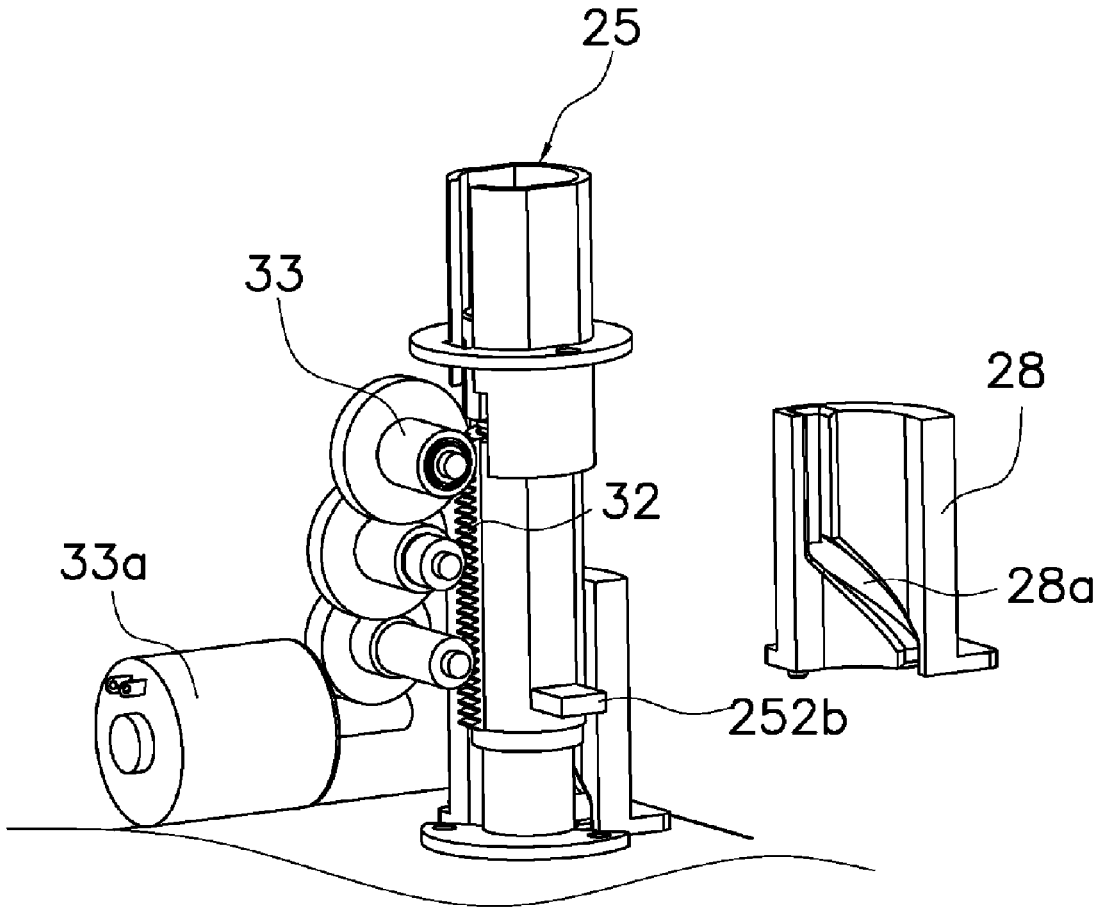
FIG. 4 is a perspective view of the toner supply pipe.

The drive mechanism 27 includes racks 32 provided on the outer circumference of the toner supply pipes 25 extending in the axial direction of the pipes 25, and pinion gears 33 engaged with the racks 32. The pinion gear 33 is rotatably supported by a frame of the device and is driven by a motor 33*a* and a worm, a worm wheel, and a train of reduction gears, as shown in FIG. 4. The drive mechanism 27 makes it possible for the four toner supply pipes 25 to move between a retracted position upward shown in solid lines in FIG. 1 and a supply position downward shown in double-dashed lines in FIG. 1, wherein the tip is inserted into the developing unit 16. As mentioned above, the laser light of the laser unit 4 passes above and on the front side of the rotary developing device 3. Namely, the laser light path and moving paths of the toner supply pipes 25 are crossed with each other so that although the laser light path is not blocked by the toner supply pipes 25 when the toner supply pipes 25 is positioned in the retracted position, the laser light path is blocked by the toner supply pipe 25 when the toner supply pipe 25 is positioned in the supply position.

The toner supply pipe 25 has a shutter mechanism which opens only when the toner supply pipe 25 is positioned in the supply position. More specifically, as shown in FIGS. 3 to 6, the toner supply pipe 25 has an overlapped structure of an inner cylinder 251 and an outer cylinder 252, and tips of the cylinders 251 and 252 are formed with openings 251*a* and 252*a* having a circumferential length. The opening 252*a* of the outer cylinder 252 has an opening angle larger than the opening 251*a* of the inner cylinder 251. In addition, as shown in FIG. 4, the outer cylinder 252 is formed with a protruding portion 252*b* engaged with a rotary cam 28 having a spiral guide portion 28*a* located around the outer cylinder 252. The rotary cam 28 is shown in an exploded view for better understanding in FIG. 4. When the toner supply pipe 25 is in the retracted position upward, the opening 251*a* of the inner cylinder 251 and the opening 252*a* of the outer cylinder 252 do not overlap with each other (shutter closed, shown in FIG. 6(*a*)) so that the toner does not leak outside. On the contrary, when the toner supply pipe 25 moves downward, the outer cylinder 252 rotates by means of the engagement between the protruding portion 252*b* and the spiral guide portion 28*a* of the rotary cam 28, the tip of the toner supply pipe 25 is inserted into the developing unit 16. Then, when the toner supply pipe 25 reaches the supply position, the opening 251*a* of the inner cylinder 251 and the opening 252*a* of the outer cylinder 252 overlap with each other (shutter opened, in FIGS. 6(*b*) and (*c*)) so that the inside toner is supplied to the inside of the developing unit 16 from the openings 251*a* and 252*a*.

Intermediate Transfer Belt

The intermediate transfer belt 7 is a member on which the toner images in each color formed on the photosensitive drum 2 are sequentially transferred and is located below the photosensitive drum 2 and the toner container 5. The intermediate transfer belt 7 is looped over a driving roller 35 and a follower roller 36 located in the opposite directions. A portion of the transfer belt 7 facing the photosensitive drum 2 is constructed so as to be brought into contact with the photosensitive drum 2 by a pair of primary transfer rollers 37*a* and 37*b*.

The arrangement of the above-mentioned components will be described in more detail. The driving roller 35 is located immediately below contact portions of the photosensitive drum 2 and the rotary developing device 3, and the center is positioned below the lowest end of the rotary developing device 3. The driving roller 35 is driven by a driving unit including a motor and a gear (not illustrated). The follower roller 36 is located adjacent to a bottom of the toner container 5 and on the front side in the device, and its position in a vertical direction is substantially the same with a position of the photosensitive drum 2. The follower roller 36 is urged by a spring 38 in the direction opposite to the driving roller 35 so that the intermediate transfer belt 7 is tensioned. In addition, the primary transfer rollers 37*a* and 37*b* are located adjacent to each other below the photosensitive drum 2 so that a certain range of the transfer belt 7 is in contact with the photosensitive drum 2.

A belt cleaning device 40 for cleaning the transfer belt 7 is located on the rear side of the driving roller 35 and below the rotary developing device 3. The belt cleaning device 40 includes a fur brush 41 located in a position facing the driving roller 35 and in sliding contact with the surface of the transfer belt 7, a cleaning roller 42 located above the fur brush 41 so as to be in contact with the fur brush 41, a blade 43 having a tip located so as to be in contact with a surface of the cleaning roller 42, and a recovery spiral 44 located below the blade 43 side by side.

In this cleaning device 40, matter attached to the intermediate transfer belt 7 is scraped off by the fur brush 41, and then are recovered to the cleaning roller 42. This matter is scraped off by the blade 43 from the surface of the cleaning roller 42 and then recovered to a recovery unit (not illustrated) by the recovery spiral 44.

Secondary Transfer Roller

The secondary transfer roller 8 is a member to transfer the image transferred on the intermediate transfer belt 7 onto the conveyed sheet and is located below the driving roller 35 and facing the driving roller 35. Bias voltage is applied to the secondary transfer roller 8 by an energizing means (not illustrated) so as to transfer the image to the sheet.

Fixing Device

The fixing device 9 is a device to fix the toner image transferred onto the sheet by fusion and is located below the rotary developing device 3 and on the rear side in the device. The fixing device 9 includes a heating roller 9*a* having a built-in heater and a pressure roller 9*b* pressing against the heating roller 9*a* for pinching the sheet therebetween so as to convey the sheet.

Discharge Unit

In the printer 1, on a surface of an upper portion of the device, i.e., above the laser unit 4, the toner supply device 6 and the toner container 5, the discharge unit 50 is provided onto which the image-formed sheet is discharged. The discharge unit 50 consists of a curved portion gradually increasing the height from the lowest portion on the laser unit 4 side (on the rear side in the device) to the other side on the toner container 5 side (on the front side in the device), and a flat portion continuous with the curved portion located above the toner container 5.

Sheet Feeding Unit

At the bottom of the device, the sheet feeding unit 51 for storing and dispatching sheets is provided. The sheet feeding unit 51 includes a sheet feeding cassette 52 having a stack plate on which the sheets are stacked, a forward feeding roller 53 and a multiple feeding prevention mechanism 54 for sending individual sheets of paper into the conveyance path. The sheet feeding cassette 52 can be pulled out toward the front side of the device.

Conveyance Mechanism

The conveyance mechanism for conveying sheets is located between the sheet feeding unit 51 and the discharge unit 50. The conveyance mechanism includes a first conveyance path 55 from the sheet feeding unit 51 to the secondary transfer roller 8, a second conveyance path 56 from the secondary transfer roller 8 to the fixing device 9, and a third conveyance path 57 from the fixing device 9 to the discharge unit 50. At an exit of the fixing device 9, a branching claw 58 is provided, and a return conveyance path 59 is provided between the branching claw 58 and a middle of the first conveyance path 55 for returning the sheet to the first conveyance path 55.

The first conveyance path 55 includes a curved path 55*a* for reversing the conveyance direction as well as conveying the sheet sent out from the sheet feeding cassette 52 upward, and a straight path 55*b* extending from the curved path 55*a* to the secondary transfer roller 8. These conveyance paths are composed of guide plates and pairs of rollers for guiding the sheets as well as conveying them, and include sensors installed at places for sensing the sheet. In addition, a pair of registration rollers 60 is provided in the straight path 55*b* for controlling conveyance timing of the sheet.

The second conveyance path 56 extends in a rectilinear direction, and is composed of guide plates and pairs of rollers for guiding the sheets as well as conveying them, and includes sensors installed at places for sensing the sheet.

The third conveyance path 57 includes a vertical conveyance path formed downstream of the branching claw 58 in the conveyance direction. Namely, the sheet is conveyed upward in the vertical direction after passing the branching claw 58 and is discharged to the discharge unit 50. The third conveyance path 57 is also composed of guide plates and pairs of rollers for guiding the sheets as well as conveying them.

The return conveyance path 59 is a conveyance path which branches off downward from the third conveyance path 57 at a place where the branching claw 58 is mounted and extends below the fixing device 9, the second conveyance path 56, the secondary transfer roller 8 and the pair of the registration rollers 60, and then extends upward so as to join upstream of the pair of the registration rollers 60 in the first conveyance path 55 in the conveyance direction. Namely, the return conveyance path 59 is a conveyance path located vertically between the sheet feeding cassette 52 and straight path 55*b* of the first conveyance path 55 as well as the second conveyance path 56. The path 59 returns the sheet passed through the fixing device 9 upstream of the pair of the registration rollers 60, which is located upstream of the secondary transfer roller 8. The return conveyance path 59 is also composed of guide plates and pairs of rollers for guiding the sheets as well as conveying them, and includes sensors installed at places for sensing the sheets.

Sheet Feeding Tray

Below the toner container 5 and above the sheet feeding cassette 52, the sheet feeding tray 65 is provided so as to form a lateral wall on the front side of the device. The sheet feeding tray 65 has a lower end pivotably supported in the vicinity of the curved path 55*a* of the first conveyance path 55 such that the sheet feeding tray 65 can take an open position and a closed position. The upper end of the sheet feeding tray 65 can be reclined toward the front side of the device around a rotation center 65*a* in the lower end. Accordingly, when the sheet feeding tray 65 is opened, it is possible to put the sheet on the sheet feeding tray 65 and supply the curved path 55*a* of the first conveyance path 55 with the sheets.

Image Forming Operation

Next, the image forming operation will be explained in a simplified manner. First, when the power is applied to the color printer 1, a variety of parameters are initialized and initialization is executed such as setting a temperature of the fixing device. Then, when the image data from the computer connected to this printer is inputted and an instruction to start printing is given, the image forming operation is carried out as follows. It should be noted that during the image forming operation, the toner supply pipe 25 is moved to the retracted position upward so that the laser path is not blocked by the toner supply pipe 25.

First, the charge roller 10 charges the photosensitive drum 2. After that, the photosensitive drum 2 is scanned and exposed by the laser unit 4 in accordance with the image data so that the electrostatic latent image is formed on the photosensitive drum 2. Next, the rotary developing device 3 is rotated and the developing unit 16 whose color is designated is opposed to the photosensitive drum 2. In this state, the electrostatic latent image on the photosensitive drum 2 is developed with the designated toner color. The developed image is transferred to the intermediate transfer belt 7. The above-mentioned operation is sequentially carried out color by color so that the full color image is formed on the intermediate transfer belt 7. It should be noted that residual toner on the photosensitive drum 2 is cleaned by the drum cleaning device 11 and is discarded into a discarded toner container (not illustrated).

In the sheet feeding unit 51, a sheet is taken out from the sheet feeding cassette 52 by the forward feeding roller 53 and multiple feeding prevention mechanism 54, and is conveyed to the pair of the registration rollers 60 through the first conveyance path 55. Then, the sheet is conveyed from the pair of the registration rollers 60 to the intermediate transfer belt 7 with timing of image forming thereon and guided to the secondary transfer roller 8. The secondary transfer roller 8 is in contact with the intermediate transfer belt 7 and the full color image formed on the intermediate transfer belt 7 is transferred to the sheet by transfer bias applied to the secondary transfer roller 8. The sheet is guided to the fixing device 9 through the second conveyance path 56, and the image is fixed to the sheet by heat and pressure in the fixing device 9. In the case of one-side printing, the sheet is guided to the third conveyance path 57 by means of the branching claw 58, and then is discharged to the discharge unit 50.

In the case of double-side printing, after fixation in the fixing device 9, the sheet is conveyed by the branching claw 58 toward the third conveyance path 57 temporarily, and then is conveyed in a reverse direction toward a side of the return conveyance path 59 after the trail end of the sheet passes the branching claw 58, and is finally returned to the first conveyance path 55 through the return conveyance path 59. The sheet is temporarily stopped by the pair of the registration rollers 60. The sheet is sent with precise timing toward the secondary transfer roller 8 after the rear side image is formed on the intermediate transfer belt 7 in the same operation mentioned before. After that, the same operation is carried out, and the sheet is guided toward the third conveyance path 57 by means of the branching claw 58 and is discharged to the discharge unit 50.

Toner Supply Operation

When the toner is supplied to the developing units 16, the rotary developing device 3 is rotated such that the developing unit 16 to which the toner will be supplied is positioned in the supply position as shown in FIG. 1. The rotary developing device 3 is locked so as not to rotate in this state. Next, the toner supply pipe 25 is moved downward to the supply position. More specifically, the motor 33*a* drives the pinion gear 33 with the gears so that the toner supply pipe 25 to which the rack 32 is fixed is moved downward. Meanwhile, the toner is conveyed to the second connection portion 26*b* from the first connection portion 26*a* through the toner conveyance portion 26*c* by rotation of the coil spring 31 in the conveyance pipe 26. It should be noted that the toner is unlikely to free fall, and is conveyed by the conveyance force of the coil spring 31 because the toner conveyance portion 26*c* is inclined upward from the first connection portion 26*a* to the second connection portion 26*b*. Accordingly, the amount of the toner supply to the developing unit 16 is managed precisely. The tip of the toner supply pipe 25 advances through the slit 18*a* as a toner supply opening and into the developing unit 16 after the toner is supplied to the toner supply pipe 25 by the conveyance pipe 26. During the downward movement of the toner supply pipe 25, the outer cylinder 252 rotates relative to the inner cylinder 251. Upon the entry of the tip of the toner supply pipe 25 into the developing unit 16, the opening 252*a* of the outer cylinder 252 and the opening 251*a* of the inner cylinder 251 correspond to each other. In other words, the shutter mechanism is opened so that the toner inside of the toner supply pipe 25 is supplied into the developing unit 16. In this case, the toner does not remain in the pipe 25 because the center axis of the toner supply pipe 25 maintains the repose angle of the toner or more relative to the horizontal line.

The amount of the toner supply from the toner container 5 to the conveyance pipe 26 is less than the toner conveyance capacity of the toner conveyance pipe 26, i.e., the largest amount of the toner conveyance by the toner conveyance pipe 26 to the toner supply pipe 25, and the toner conveyance capacity of the conveyance pipe 26 to the toner supply pipe 25 is less than the toner supply capacity of the toner supply pipe 25 to the developing unit 16. Accordingly, the conveyance pipe 26 and the toner supply pipe 25 are unlikely to be plugged up by the toner, so that the management accuracy of the toner supply amount is unlikely to deteriorate.

It should be noted that although the toner supply pipe 25 blocks the laser light path from the laser unit 4 to the photosensitive drum 2 when toner supply pipe 25 is positioned in the supply position, it is not a cause for concern because the toner supplying operation by the toner supply pipe 25 and the image forming operation are not carried out simultaneously.

Upon the end of the toner supply, the coil spring 31 in the conveyance pipe 26 stops rotating. On the contrary, the spiral member 30 located in the toner supply pipe 25 continues to rotate until the toner is completely consumed in the toner supply pipe 25. After that, the motor 33*a* is rotated in a reverse direction so as to rotate the pinion gear 33 in the reverse direction so that the toner supply pipe 25 to which the rack 32 is fixed is moved upward. At this time, the outer cylinder 252 rotates in the reverse direction so that the opening 251*a* of the inner cylinder 251 and the opening 252*a* of the outer cylinder 252 are misaligned so as to close the opening, i.e., the shutter is closed. In the toner supply portion 18 of the developing unit 16, when the toner supply pipe 25 is pulled out from the slit 18*a*, the slit 18*a* is also closed by its elastic force. Accordingly, the toner does not scatter in the device from the toner supply pipe 25 and the developing unit 16.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application Nos. 2004-315773, 2005-023821, and 2005-186911. The entire disclosure of Japanese Patent Application Nos. 2004-315773, 2005-023821, and 2005-186911 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A image forming device comprising:

a toner container being configured to contain toner;

an image bearing member having a surface being configured to have an electrostatic image formed thereon;

a developing device having a plurality of developing units being located corresponding to different developing colors, and a rotary frame maintaining the developing units in a circumferential direction in order to place each of the developing units opposite the image bearing member via rotation; and a toner supply device being configured to supply toner contained in the toner container to the developing device, the toner supply device having a conveyance pipe being connected to the toner container, the conveyance pipe conveying the toner from the toner container to the developing device, at least one supply pipe being configured to supply the toner from the conveyance pipe downward to the developing device, the at least one supply pipe having an upper portion connected to the conveyance pipe and a lower end configured to advance into the developing device, the at least one supply pipe having a center axis of the supply pipe slanted relative to the horizontal line at a repose angle of the toner or more, the supply pipes being located to correspond to the developing units, and a conveyance member being rotatably located in the supply pipe, the conveyance member conveying the toner downward.

2. A toner supply device configured to supply toner contained in a toner container to a developing device in an image forming device, comprising:

a conveyance pipe being connected to the toner container, the conveyance pipe conveying the toner from the toner container to the developing device;

at least one supply pipe being configured to supply the toner from the conveyance pipe downward to the developing device, the at least one supply pipe having an upper portion connected to the conveyance pipe and a lower end configured to advance into the developing device, the at least one supply pipe having a center axis of the supply pipe slanted relative to the horizontal line at a repose angle of the toner or more, the at least one supply pipe having a shutter mechanism prohibiting and allowing the toner to be supplied to the developing device; and a conveyance member being rotatably located in the supply pipe, the conveyance member conveying the toner downward.

3. The toner supply device according to claim 2, wherein the supply pipe includes an inner cylinder having an inner opening at a tip thereof, and an outer cylinder rotatably located around the inner cylinder and having an outer opening at a lateral surface of a tip thereof, and wherein the shutter mechanism is formed by the inner cylinder and the outer cylinder.

4. The toner supply device according to claim 3, further comprising a driving device to move the tip of the supply pipe into the developing device and away from the developing device; and a shutter driving mechanism to align at least parts of the inner opening of the inner cylinder and the outer opening of the outer cylinder with each other when the tip of the supply pipe advances into the developing device, and to misalign the inner opening with the outer opening when the tip is located outside of the developing device.

5. The toner supply device according to claim 4, wherein the outer opening of the outer cylinder is larger than the inner opening of the inner cylinder.

6. The toner supply device according to claim 4, wherein the shutter driving mechanism rotates the outer cylinder as the supply pipe is moved by means of the driving device.

7. The toner supply device according to claim 6, wherein the shutter driving mechanism includes a guide portion located on an outer circumference of the outer cylinder, and a spiral guide groove around the outer cylinder into which the guide portion is inserted.

8. The image forming device according to claim 1, wherein the developing unit is formed with a toner supply opening, and a shutter is provided at the opening of the developing unit for toner supply.

9. An image forming device comprising;

an image forming unit being configured to forming a toner image and being configured to transfer the toner image onto a transfer medium;

a sheet conveyance unit being configured to convey the transfer medium to the image forming unit; and a toner supply unit being configured to supply toner to the image forming unit, the toner supply unit including a toner supply member being configured to supply toner to the image forming unit, a toner container being configured to store toner, and a toner conveyance unit having a toner conveyance member inside being configured to convey the toner in the toner container to the toner supply member, the toner conveyance unit having a portion upstream in a toner conveyance direction that is lower than a portion thereof that is downstream in the toner conveyance direction.

10. The image forming device according to claim 9, wherein a connected portion between the toner conveyance unit and the toner container is located lower than a connected portion between the toner conveyance unit and the toner supply member.

11. The image forming device according to claim 9, wherein the amount of toner conveyed by the toner conveyance unit is less than the toner supply capacity of the toner supply member.

12. The image forming device according to claim 11, wherein the amount of toner supplied from the toner container to the toner conveyance unit is less than the toner conveyance capacity of the toner conveyance unit.

13. An image forming device according to claim 9, wherein a connected portion between the toner supply member and the toner conveyance unit is positioned in a position that is higher than a portion of the toner conveyance unit that is upstream near the connected portion between the toner container and the toner conveyance unit.

* * * * *